US006190123B1

(12) United States Patent
Wunderwald et al.

(10) Patent No.: US 6,190,123 B1
(45) Date of Patent: Feb. 20, 2001

(54) CENTRIFUGAL COMPRESSOR

(75) Inventors: Dirk Wunderwald, Baden; Martin Thiele, Baden-Rütihof, both of (CH)

(73) Assignee: Asea Brown Boveri AG, Baden (CH)

( * ) Notice: Under 35 U.S.C. 154(b), the term of this patent shall be extended for 0 days.

(21) Appl. No.: 09/316,066

(22) Filed: May 21, 1999

(30) Foreign Application Priority Data

May 25, 1998 (EP) ..... 98810486

(51) Int. Cl.[7] ..... F01D 11/00
(52) U.S. Cl. ..... 415/168.1; 415/1; 415/116
(58) Field of Search ..... 415/1, 116, 121.2, 415/168.1, 168.2, 168.3, 168.4; 417/435, 440

(56) References Cited

U.S. PATENT DOCUMENTS 2,260,042 10/1941 McMahan .
3,663,117 * 5/1972 Warren ..... 415/116
4,170,435 * 10/1979 Swearingen ..... 415/1

FOREIGN PATENT DOCUMENTS 403277 9/1924 (DE) .
195 48 852A1 7/1997 (DE) .
0076668 4/1983 (EP) .
0518027A1 12/1992 (EP) .
0518027B1 12/1992 (EP) .
2277129 10/1994 (GB) .

* cited by examiner

*Primary Examiner*—Edward K. Look
*Assistant Examiner*—Hermes Rodriguez
(74) *Attorney, Agent, or Firm*—Burns, Doane, Swecker & Mathis, L.L.P.

(57) ABSTRACT

The object of the invention is to provide a method of operating a simply constructed centrifugal compressor equipped, in the region of the rear wall of the compressor impeller, with no sealing elements in the separating gap between the compressor impeller and the compressor casing, which method increases the service life of the centrifugal compressor. An appliance for carrying out the method is also to be made available. In accordance with the invention, this is achieved by introducing a cooling medium into the separating gap downstream of the leakage flow of the working medium and by finally removing this again after the cooling process has taken place. For this purpose, at least one supply duct for a gaseous cooling medium, the duct penetrating the compressor casing, opening into the separating gap in the region of the rear wall of the compressor impeller and directed onto the rear wall, and at least one removal duct for the cooling medium are arranged in the compressor casing.

14 Claims, 3 Drawing Sheets

CENTRIFUGAL COMPRESSOR

FIELD OF THE INVENTION

The invention relates to a method of operating a centrifugal compressor as described in the preamble amble to claim 1 and to a corresponding centrifugal compressor as described in the preamble to claim 6.

BACKGROUND OF THE INVENTION

Contactless seals, in particular labyrinth seals, are widely used for sealing rotating systems in turbomachine construction. Because of the aerodynamic boundary layers which form, a high frictional power appears in the separating gap through which fluid flows between the rotating and stationary parts. This causes heating of the fluid in the separating gap and therefore also causes heating of the components surrounding the separating gap. The high material temperatures cause a reduction in the life of the corresponding components.

Depending on their design, exhaust gas turbochargers have an axial thrust from the exhaust gas turbine which acts against or in the same direction as that from the centrifugal compressor. In the latter case, the resulting pressure in the separating gap between the rotating rear wall of the compressor impeller and the adjacent stationary compressor casing has to be reduced. For this reason, such separating gaps have very tight tolerances. In addition, they usually have a contactless seal. Such narrow separating gaps involve a particularly high frictional power. In addition, the deflection and the eddying of the working fluid flowing through the separating gap lead to repeated mixing of the working fluid at the throttle locations of the seal and this is associated with a high level of momentum and heat exchange. Downstream of the throttle location, the working fluid has to be accelerated afresh each time in the peripheral direction on the rotating component so that the frictional power, and therefore the generation of heat, increases further in this region.

A cooling appliance for centrifugal compressors with sealing elements arranged on the rear wall of the compressor impeller, in the separating gap between the latter and the compressor casing, is known from EP 0 518 027 B1. In this arrangement, a cold gas which is provided with a pressure which is higher than that present at the outlet from the compressor impeller is fed through the seal. This gas impinges on the rear wall of the compressor impeller and simultaneously acts there as sealing air to prevent a flow of hot compressor air from the outlet of the compressor impeller through the labyrinth gap. The service life of such a compressor wheel provided with sealing geometry can be markedly increased by this means. In this solution, it is found to be a disadvantage that the specially shaped seal complicates the overall design and the assembly of the compressor and makes it more expensive. Because the clearance of the separating gap is in the range of tenths of a millimeter, furthermore, there is always a latent danger of the rotating compressor impeller rubbing on the compressor casing.

In contrast to this, no reduction in pressure in the separating gap is necessary in the case of an axial thrust of the exhaust gas turbine acting against the centrifugal compressor so that its clearance is in the range of millimeters and it becomes unnecessary to seal the separating gap in the region of the rear wall of the compressor impeller. A centrifugal compressor without such sealing elements is known from DE 195 48 852. It is simple in construction and therefore can be manufactured at favorable cost. There is no danger of the rotating compressor impeller rubbing against the compressor casing. Nevertheless, even in this case the frictional heat resulting from aerodynamic shear layers on the rear wall of the compressor impeller ensures heating of the compressor impeller and, therefore, a reduction in its life. No solution for reducing the generation of heat in the case of centrifugal compressors without sealing elements in the region of the rear wall of the compressor impeller is known.

SUMMARY OF THE INVENTION

The invention attempts to avoid all these disadvantages and, accordingly, one object of the invention is to provide a novel method of operating a simply constructed centrifugal compressor equipped, in the region of the rear wall of the compressor impeller, with no sealing elements in the separating gap between the compressor impeller and the compressor casing, which method increases the service/life of the centrifugal compressor. In addition, an appliance is made available for carrying out the method.

In a method according to the invention, this is achieved by a cooling medium being introduced into the separating gap downstream of the leakage flow of the working medium and the cooling medium being finally removed again after heat exchange has taken place. For this purpose, in an appliance according to the invention, at least one supply duct for a gaseous cooling medium, said duct penetrating the compressor casing, opening into the separating gap in the region of the rear wall, of the compressor impeller and directed onto the rear wall, and at least one removal duct for the cooling medium are arranged in the compressor casing.

On the basis of this method and the corresponding configuration of the centrifugal compressor, the rear wall of the compressor impeller can be effectively cooled by means of the gaseous cooling medium and the service life of the centrifugal compressor can therefore be increased. Because cooling of the hot leakage flow of the working medium by the cooling medium is already sufficient for this purpose, it is not necessary to prevent the penetration of the leakage flow into the separating gap. In consequence, even the supply of relatively small quantities of the cooling medium are sufficient so that a simple supply arrangement can be employed.

Because the pressure of the leakage flow of the working medium is reduced when supplied into the separating gap, as compared with the pressure of the main flow of the working medium, the cooling medium can be advantageously introduced into the separating gap at a pressure which is either higher or lower than the pressure of the main flow of the working medium. For this purpose, a sealing element is arranged in the separating gap upstream of the rear wall of the compressor impeller. The removal of the used cooling medium takes place through the compressor casing, either to the atmosphere or to the main flow of the working medium of the centrifugal compressor, for which purpose the removal duct for the cooling medium either opens into the ambient air or into the flow duct of the centrifugal compressor. In this way, numerous variation possibilities follow for the cooling the compressor impeller and these permit optimum adaptation of the centrifugal compressor to the conditions present in its application.

The supply duct for the cooling medium is arranged to open into the separating gap approximately parallel or approximately diagonally to the shaft of the compressor impeller, or else approximately tangentially to the rear wall of the compressor impeller. Impingement cooling is achieved in the case of a supply of the cooling medium taking place parallel to the direction of the shaft. In this way, particularly endangered positions on the rear wall of the compressor impeller can be directly and effectively cooled. On the other hand, film cooling is achieved by a radial feed of the cooling medium, with the aid of which even larger regions of the rear wall of the compressor impeller can be cooled. The diagonal feed of the cooling medium combines the advantages of the solutions previously described, although with lower cooling effectiveness. In order to provide compensation for this disadvantage, at least one of the supply ducts accommodates a tube projecting into the separating gap and directed onto the rear wall of the compressor impeller. It is particularly advantageous for each of the tubes to open into the separating gap in the region of the radially outer wall part of the rear wall of the compressor impeller. An effective employment of the cooling medium can be achieved by this means because the maximum temperature loading is to be expected in this region.

It is also advantageous, if a plurality of supply ducts are arranged in the compressor casing, for an annular space which is open toward the separating gap, or at least a partial annular space, to be formed opposite to the rear wall of the compressor impeller in the compressor casing and for the supply ducts to be connected to the annular space or at least two of the supply ducts to be connected to each partial annular space. A uniform supply of cooling medium over the periphery of the compressor impeller can be achieved by this means, independent of the number, the configuration and the arrangement of the supply ducts.

BRIEF DESCRIPTION OF THE DRAWINGS

A more complete appreciation of the invention and many of the attendant advantages thereof will be readily obtained as the same becomes better understood by reference to the following detailed description of several embodiment examples of the invention, using the centrifugal compressor of an exhaust gas turbocharger, when considered in connection with the accompanying drawings, wherein.

DESCRIPTION OF THE PREFERRED EMBODIMENTS

Figure 1:
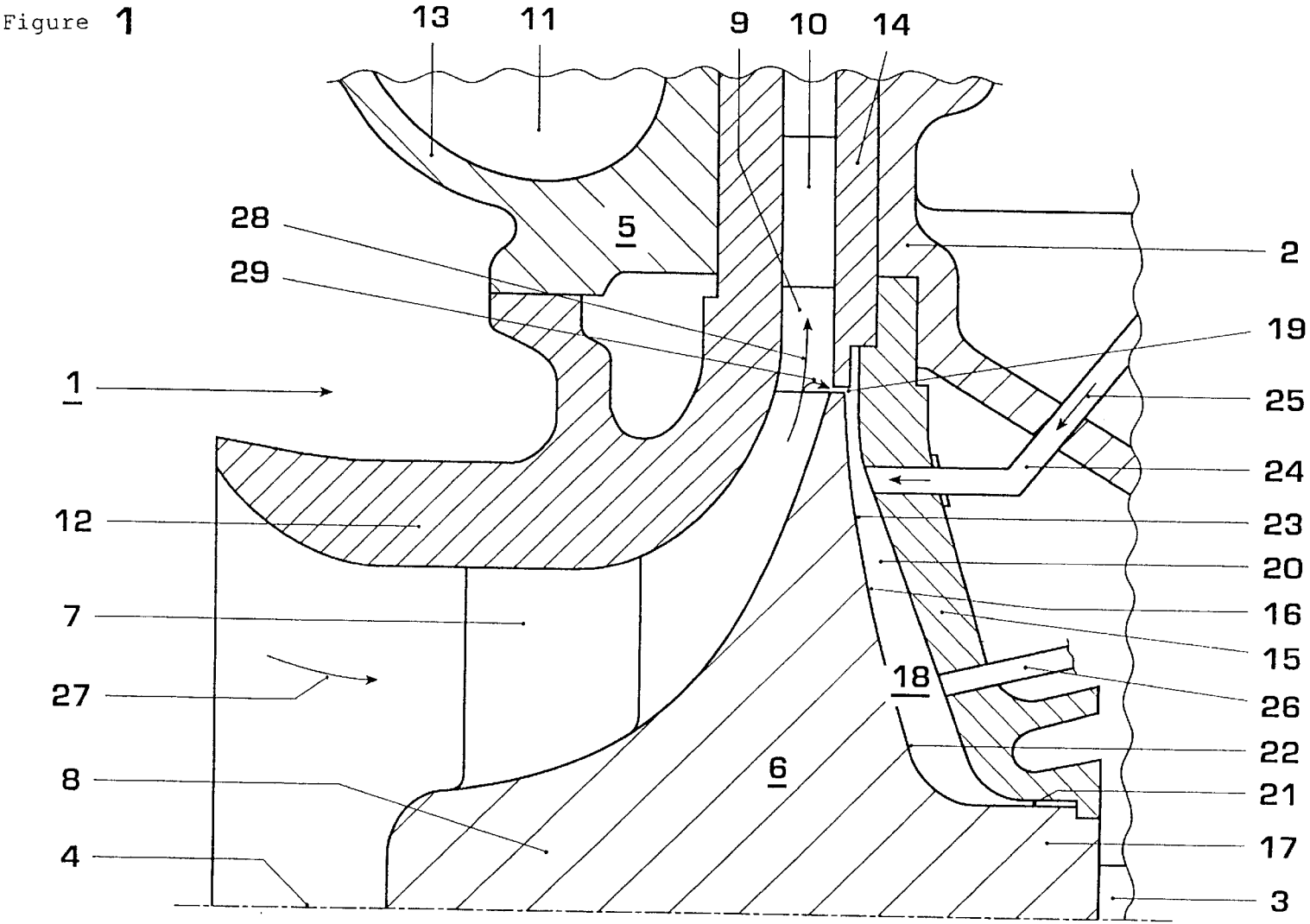
FIG. 1 shows a partial longitudinal section through the centrifugal compressor, with the supply and removal device according to the invention.

Referring now to the drawings, wherein like reference numerals designate identical or corresponding parts throughout the several views, and wherein only the elements essential to understanding the invention are shown (not shown, for example, are the bearing parts and the turbine end of the exhaust gas turbocharger) and the flow direction of the working media is indicated by arrows, in FIG. 1 the exhaust gas turbocharger which is only partially shown consists of a centrifugal compressor 1 and an exhaust gas turbine (not shown) which are connected together by means of a shaft 3 supported in a bearing housing 2. The centrifugal compressor 1 has a machine center line 4 located in the shaft 3. It is equipped with a compressor casing 5 in which a compressor impeller 6 is rotatably connected to the shaft 3. The compressor impeller 6 has a hub 8 occupied by a plurality of impeller vanes 7. A flow duct 9 is formed between the hub 8 and the compressor casing 5. Downstream of the impeller vanes 7, the flow duct 9 is followed by a radially arranged, vaned diffuser 10 which in turn opens into a volute 11 of the centrifugal compressor 1. The compressor casing 5 consists mainly of an air inlet casing 12, an air outlet casing 13, a diffuser plate 14 and an intermediate wall 15 leading to the bearing housing 2.

At the turbine end, the hub 8 has a rear wall 16 and a fastening sleeve 17 for the shaft 3, the latter and the fastening sleeve 17 being connected together. The fastening sleeve 17 is accommodated by the intermediate wall 15 of the compressor casing 5. Another suitable compressor impeller/shaft connection can, of course, also be selected. The employment of an unvaned diffuser is also similarly possible.

A separating gap 18 consisting of various gap regions is formed between the rotating compressor impeller 6 and the stationary intermediate wall 15 of the compressor casing 5. A first gap region 19 extends parallel to the machine center line 4 and is connected to both the outlet of the compressor impeller 6 and a second gap region 20 extending substantially radially in the region of the rear wall 16 of the compressor impeller 6. The second gap region 20 merges into a third gap region 21 formed between the fastening sleeve 17 and the intermediate wall 15 and likewise extending parallel to the machine center line 4. The latter communicates in turn with a removal conduit (not shown). The rear wall 16 of the compressor impeller 6 has a radially inner wall part 22 and a radially outer wall part 23.

A plurality of supply ducts 24 for a gaseous cooling medium 25, which penetrate the intermediate wall 15 of the compressor casing 5, open into the second gap region 20 of the separating gap 18 parallel to the shaft 3 of the compressor impeller 6. The openings are located in the region of the radially outer wall part 23 of the rear wall 16 of the compressor impeller 6 while a removal duct 26 for the cooling medium 25, likewise penetrating the intermediate wall 15 of the compressor casing 5, is arranged in the region of the radially inner wall part 22.

During operation of the exhaust gas turbo-charger, the compressor impeller 6 induces ambient air as the working medium 27 and this ambient air reaches the volute 11 as a main flow 28 via the flow duct 9 and the diffuser 10, is further compressed there and is finally employed for supercharging an internal combustion engine (not shown) which is connected to the exhaust gas turbocharger. On its way from the flow duct 9 to the diffuser 10, the main flow 28 of the working medium 27, which has been heated in the centrifugal compressor 1, is also admitted as a leakage flow 29 to the first gap region 19 and therefore to the separating gap 18. At the same time, however, the gaseous cooling medium 25 is introduced via the supply ducts 24 at a higher pressure than that of the main flow 28 of the working medium 27 into the second gap region 20 of the separating gap 18. Air from the outlet (not shown) of the charge air cooler of the internal combustion engine can, for example, be used as the cooling medium. The employment of other cooling media and an external supply of these cooling media are, of course, both possible.

The cooling medium 25 meets the rear wall 16 of the compressor impeller 6 and effects impingement cooling in this particularly loaded, radially outer wall part 23. The cooling medium 25 then divides in the separating gap 18 and dilutes the hot leakage flow 29. The major portion of the cooling medium 25 and the leakage flow 29 is subsequently led out of the separating gap 18 via the removal duct 26. Depending on the pressure relationships present, a certain portion of the cooling medium 25 and the leakage flow 29 is also introduced into the flow duct 9 of the radial compressor 1 via the first gap region 19.

Figure 2:
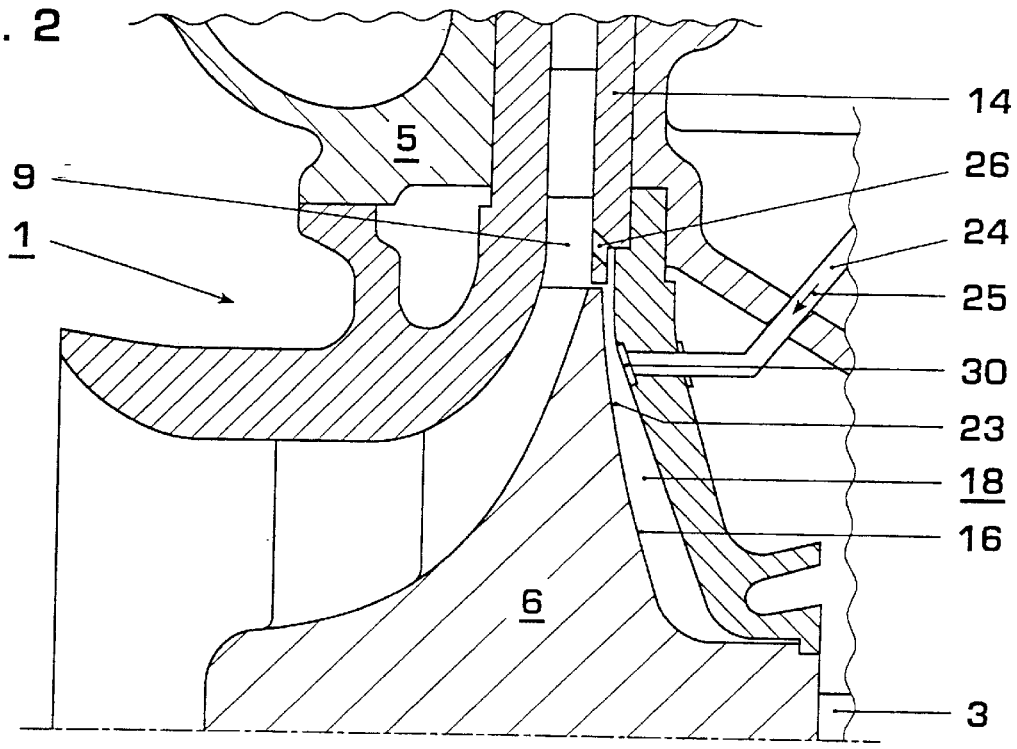
FIG. 2 shows a representation in accordance with FIG. 1, but in a second embodiment example.

In a second embodiment example, the supply ducts 24 for the cooling medium 25 likewise open into the separating gap 18 parallel to the shaft 3 of the compressor impeller 6 in the region of the radially outer wall part 23 of the rear wall 16 of the compressor impeller 6. However, an annular space 30 connecting the supply ducts 24 together and open to the separating gap 18 is formed between the supply ducts 24 and the separating gap 18 (FIG. 2). By this means, a relatively uniform admission of the cooling medium 25 to the rear wall 16 can be achieved. As an alternative to the annular space 30, a plurality of partial annular spaces can of course also be formed in the intermediate wall 15 of the compressor casing 5, each of these partial annular spaces joining together at least two adjacent supply ducts 24 (not shown). The removal duct 26 is arranged in the diffuser plate 14 of the compressor casing 5 so that the cooling medium 25 is almost completely removed via the flow duct 9 of the radial compressor 1. In operation, the leakage flow 29 is almost completely blocked by the cooling medium 25. The volumetric efficiency is, furthermore, improved because of the return of the cooling medium 25 into the flow duct 9.

Figure 3:
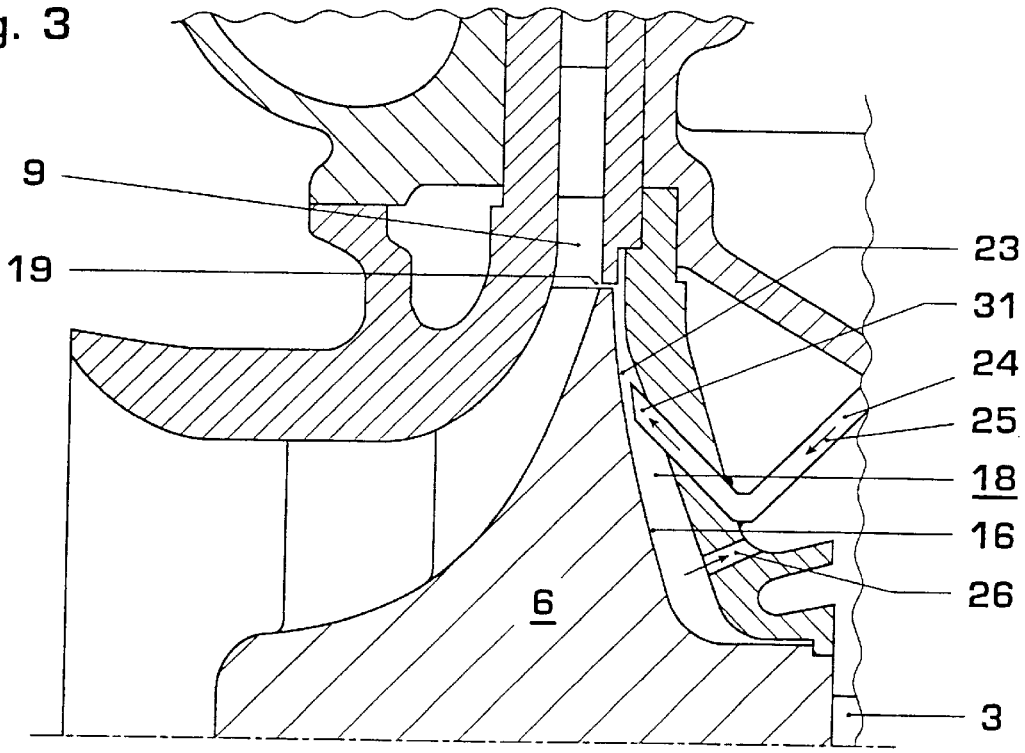
FIG. 3 shows a representation in accordance with FIG. 1, but in a third embodiment example.

In accordance with a third embodiment example, the supply ducts 24 open into the separating gap 18 diagonally to the shaft 3 of the compressor impeller 6. In addition, the supply ducts 24 each accommodate a tube 31, which protrudes into the separating gap 18 and is directed onto the radially outer wall part 23 of the rear wall 16 of the compressor impeller 6 (FIG. 3). By means of these tubes 31, the cooling medium 25 specifically impinges on the regions of the rear wall 16 which have the maximum temperature loading. Because of its diagonal introduction, the cooling medium 25 acts initially as impingement cooling. In addition, a cooling film can attach itself to the rear wall 16 in the direction of the first gap region 19. The removal of the cooling medium 25 again takes place via the removal duct 26. By analogy with the second embodiment example, the cooling medium 25 can also, of course, be fed back into the flow duct 9 of the centrifugal compressor 1 (not shown).

Figure 4:
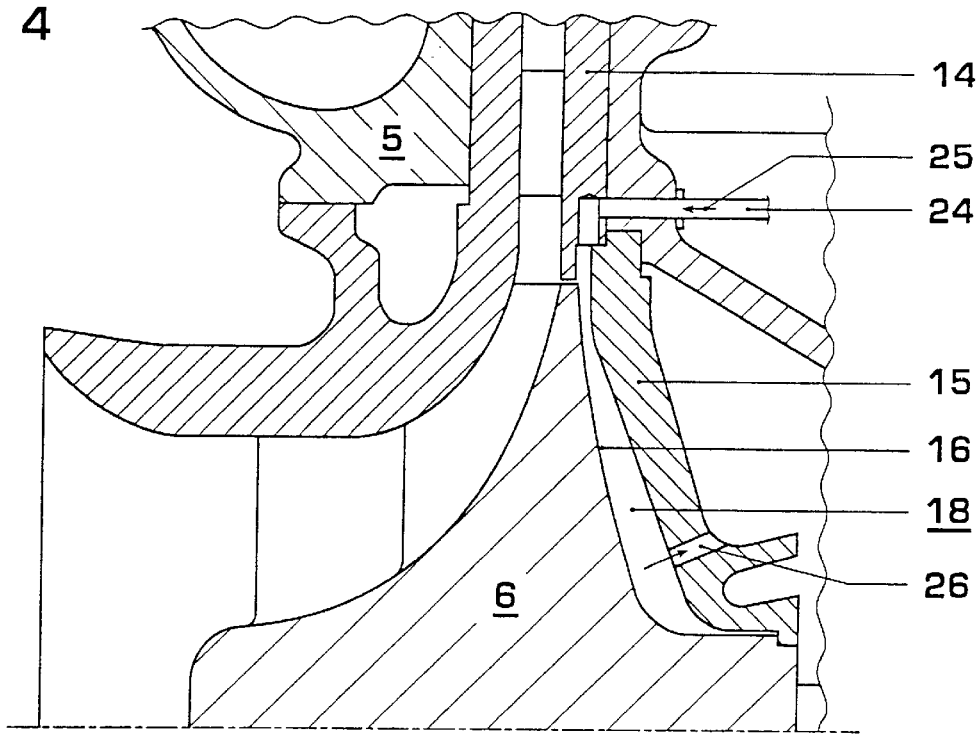
FIG. 4 shows a representation in accordance with FIG. 1, but in a next embodiment example.

In a next embodiment example, the supply ducts 24 are arranged so that they penetrate the diffuser plate 14 and open into the separating gap 18 tangentially to the rear wall 16 of the compressor impeller 6 in their region facing toward the compressor impeller 6 (FIG. 4). The removal duct 26 for the cooling medium 25 is arranged in the intermediate wall 15 of the compressor casing 5. Pure film cooling of the whole of the rear wall 16 of the compressor impeller 6 is achieved by means of the tangential introduction of the cooling medium 25. The removal of the cooling medium 25 takes place only via the removal duct 26. In this arrangement, both the compressor thrust and the mechanical losses because of the friction occurring on the rear wall 16 of the compressor impeller 6 are smaller than when the cooling medium 25 is blown in parallel to the center line. The diffuser plate 14 can also, of course, have a slotted configuration at its radially inner end. In this case, the supply ducts 24 open into the slot (not shown) of the diffuser plate 14.

Figure 5:
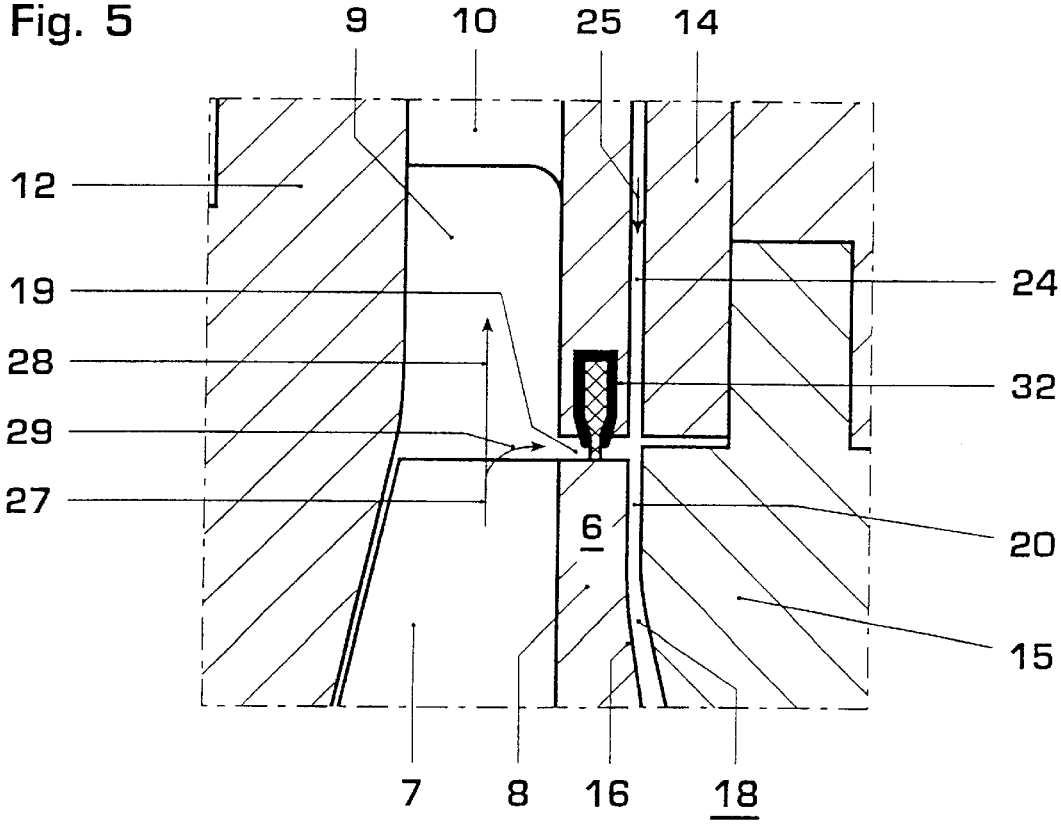
FIG. 5 shows an enlarged excerpt from FIG. 4 which represents, in particular, the first gap region of the separating gap in a further embodiment example.

In a further embodiment example, a sealing element 32 is arranged in the separating gap 18, i.e. in its first gap region 19, upstream of the rear wall 16 of the compressor impeller 6 (FIG. 5). By means of this solution, which is suitable for all the previously described embodiment examples, it is possible to reduce the pressure of the residual leakage flow 29 to such an extent that the pressure of the inflowing cooling medium 25 can advantageously be even below the pressure of the working medium 27 present at the outlet of the compressor impeller 6. In this way, effective cooling of the compressor impeller 6 can be ensured even with relatively small quantities of the cooling medium 25.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a centrifugal compressor, in which a) a working medium is induced by a compressor impeller arranged in a compressor casing and equipped with a number of impeller vanes, is compressed and is led on to a consumption unit as a main flow, b) after the compression process which takes place between the impeller vanes, a leakage flow of the working medium branches off and this leakage flow flows into a separating gap formed between the compressor impeller and the compressor casing, c) the separating gap is not sealed against the penetration of the leakage flow of the working medium in the region of a rear wall of the compressor impeller, wherein d) a cooling medium is introduced into the separating gap downstream of the leakage flow of the working medium and this cooling medium is finally removed again after the cooling process has taken place.

2. The method as claimed in claim 1, wherein the cooling medium is introduced into the separating gap at a pressure which is higher than the pressure of the main flow of the working medium.

3. The method as claimed in claim 2, wherein the cooling medium is introduced into the main flow of the working medium after the cooling process has taken place.

4. The method as claimed in claim 1, wherein the pressure of the leakage flow of the working medium is reduced, when it is supplied to the separating gap, relative to the pressure of the main flow of the working medium.

5. The method as claimed in claim 4, wherein the cooling medium is introduced into the separating gap at a pressure which is lower than the pressure of the main flow of the working medium.

6. A centrifugal compressor having a compressor impeller, which is arranged on a shaft and has a rear wall extending mainly radially, having a compressor casing enclosing the compressor impeller, having a flow duct formed between the compressor impeller and the compressor casing for a working medium of the centrifugal compressor and having a separating gap, which is connected to the flow duct, between the compressor impeller and the compressor casing, the separating gap being configured without sealing elements in the region of the rear wall of the compressor impeller, wherein at least one supply duct for a gaseous cooling medium, said duct penetrating the compressor casing, opening into the separating gap in the region of the rear wall of the compressor impeller and directed onto the rear wall, and at least one removal duct for the cooling medium are arranged in the compressor casing.

7. The centrifugal compressor as claimed in claim 6, wherein the supply duct opens into the separating gap at least approximately parallel to the shaft of the compressor impeller.

8. The centrifugal compressor as claimed in claim 6, wherein the supply duct opens into the separating gap at least approximately diagonally to the shaft of the compressor impeller.

9. The centrifugal compressor as claimed in claim 7, wherein a plurality of supply ducts are arranged in the compressor casing, wherein an annular space which is open toward the separating gap, or at least a partial annular space, is formed opposite to the rear wall of the compressor impeller in the compressor casing and wherein the supply ducts are connected to the annular space or at least two of the supply ducts are connected to each partial annular space.

10. The centrifugal compressor as claimed in claim 8, wherein at least one of the supply ducts accommodates a tube protruding into the separating gap and directed onto the rear wall of the compressor impeller.

11. The centrifugal compressor as claimed in claim 10, wherein the rear wall of the compressor impeller has a radially inner wall part and a radially outer wall part and each tube opens into the separating gap in the region of the radially outer wall part.

12. The centrifugal compressor as claimed in claim 6, wherein the removal duct opens into the flow duct of the centrifugal compressor.

13. The centrifugal compressor as claimed in claim 6, wherein the supply duct opens into the separating gap at least approximately tangentially to the rear wall of the compressor impeller.

14. The centrifugal compressor as claimed in claim 6, wherein a sealing element is arranged in the separating gap upstream of the rear wall of the compressor impeller.

* * * * *